US006785994B2

(12) United States Patent
Christiansen

(10) Patent No.: US 6,785,994 B2
(45) Date of Patent: Sep. 7, 2004

(54) SPRING-LOADED FIREARM SAFETY INDICATOR

(76) Inventor: Ned F. Christiansen, 55017 Flatbrush Rd., Three Rivers, MI (US) 49093

( * ) Notice: Subject to any disclaimer, the term of this patent is extended or adjusted under 35 U.S.C. 154(b) by 0 days.

(21) Appl. No.: 10/464,381

(22) Filed: Jun. 17, 2003

(65) Prior Publication Data

US 2003/0230020 A1 Dec. 18, 2003

Related U.S. Application Data

(60) Provisional application No. 60/389,576, filed on Jun. 17, 2002.

(51) Int. Cl.[7] ..... F41A 9/53; F41A 17/42

(52) U.S. Cl. ..... 42/1.05; 42/1.01; 42/70.11

(58) Field of Search ..... 42/1.05, 1.01, 42/70.11

(56) References Cited

U.S. PATENT DOCUMENTS 2,997,802 A * 8/1961 Robbins ..... 42/70.01
3,570,161 A * 3/1971 Nordhauser ..... 42/70.11
3,605,311 A * 9/1971 Hermann ..... 42/70.11
3,634,963 A * 1/1972 Hermann ..... 42/70.11
4,835,894 A * 6/1989 Libassi ..... 42/70.11
4,965,952 A 10/1990 Miller et al.
5,097,613 A 3/1992 Miller et al.
5,311,691 A 5/1994 Cacek
5,361,526 A * 11/1994 Campbell ..... 42/70.11
5,419,069 A * 5/1995 Mumbleau et al. ..... 42/70.11
5,632,108 A * 5/1997 Ruger et al. ..... 42/1.01
5,669,252 A * 9/1997 Bentley ..... 70/14
6,591,532 B1 * 7/2003 Gilbertson et al. ..... 42/70.11

* cited by examiner

*Primary Examiner*—Charles T. Jordan
*Assistant Examiner*—John W. Zen
(74) *Attorney, Agent, or Firm*—Geoffrey E. Dobbin

(57) ABSTRACT

The invention is a firearm safety indicator that is spring-loaded, thus enabling self-ejection when a firearm's bolt is actuated. To attain this, the indicator comprises a main body and cantilever spring body joined together. A peg extends perpendicularly from the main body. In use, the peg is positioned inside the firing chamber of a firearm through the ejection port. The main body covers the ejection port and the cantilever spring body is therefore compressed to attain proper positioning. The rifle's bolt is then used to engage and hold the peg in place. When actuated, the bolt releases the peg and the spring body is released, thrusting the indicator away from the firearm. Alternately, a metal spring may be utilized in the place of the cantilever spring body.

24 Claims, 7 Drawing Sheets

SPRING-LOADED FIREARM SAFETY INDICATOR

CROSS-REFERENCES TO RELATED APPLICATIONS

This Application claims priority based on Provisional Application 60/389,576, filed Jun. 17, 2002.

FIELD OF INVENTION

The present invention relates to a firearm safety indicator for revealing a rifle's unloaded status to a casual viewer and more specifically relates to such an indicator that is spring-loaded so that the action of charging a weapon automatically releases the indicator.

BACKGROUND OF THE INVENTION

The need for safety indicators for firearms arises from the need of police officers and military personnel to have a loaded weapon on their person while simultaneously having that weapon in some form of "safe" configuration (i.e. no round of ammunition in the chamber). The interest of safety requires that a weapon's status be both real and known at a glance. As such, the indicators used in the past have in some way blocked the chamber or otherwise arrested the rifle's bolt and extended outside the weapon, either through the chamber ejection port or through the barrel, or some other orifice in the weapon. The interest of readiness requires that the state of safety be changed at a moment's notice. Therefore, the safety device must be quickly removed. Some devices have been designed with rapid removal in mind. Earlier such "instant" safety devices had to be removed physically relied on the weight and balance of the device and gravity, or the weapon's ejection mechanism to remove the device from the chamber. Earlier devices have not been spring-loaded, much less being spring-loaded inherently in their construction. The present invention is spring-loaded in its construction, and therefore departs from the usual manner and construction of other such safety devices. Prior art safety devices include U.S. Pat. No. 5,311,691 (1994) to Cacek; U.S. Pat. No. 5,097,613 (1992) to Miller, et al.; and U.S. Pat. No. 4,965,952 (1990) to Miller, et al. As additional benefits of the present invention, the indicator may be constructed of a fluorescent plastic to better enable location and analysis of a shooting scene. The spring according to the present invention is uniform from indicator to indicator and can be readily converted into analysis information to locate where a weapon was initially charged. Also, the indicator according to the present invention, like prior art indicators, prevents a round of ammunition from being in the chamber when the indicator would otherwise be simultaneously installed.

SUMMARY OF THE INVENTION

In view of the foregoing disadvantages inherent in the known types of firearm safety devices, this invention provides an improved, firearm safety indicator device. As such, the present invention's general purpose is to provide a new and improved firearm safety device that will automatically self-eject from the chamber when the weapon's bolt is actuated and not utilize the weapon's ejection mechanism.

To attain the goal of self-ejection, the safety device generally comprises a rectilinear indicator body that is sufficient in size to cover a weapon's ejection port. In the preferred embodiment, the body is almost completely divided lengthwise into two sections, leaving both a split end and a juncture of the two sections. The spring section bends slightly away from the main body section, forming a cantilever spring. A peg extends outwardly from the main body at the split end in the direction of the spring section's bend. In use, the peg is inserted towards the forward area of the firearm's chamber and the bolt is closed upon the peg. During this process, the spring section is compressed flush with the main body section and stores potential energy for self-ejection. When the bolt of the firearm is actuated, so as to load a cartridge into the chamber, the safety device is released and the spring section returns to its normal position, thrusting the device away from the weapon.

The more important features of the invention have thus been outlined in order that the more detailed description that follows may be better understood and in order that the present contribution to the art may better be appreciated. Additional features of the invention will be described hereinafter and will form the subject matter of the claims that follow.

The primary object of the present invention is to provide a self-ejecting firearm safety indicator; however, other objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

Figure 1:
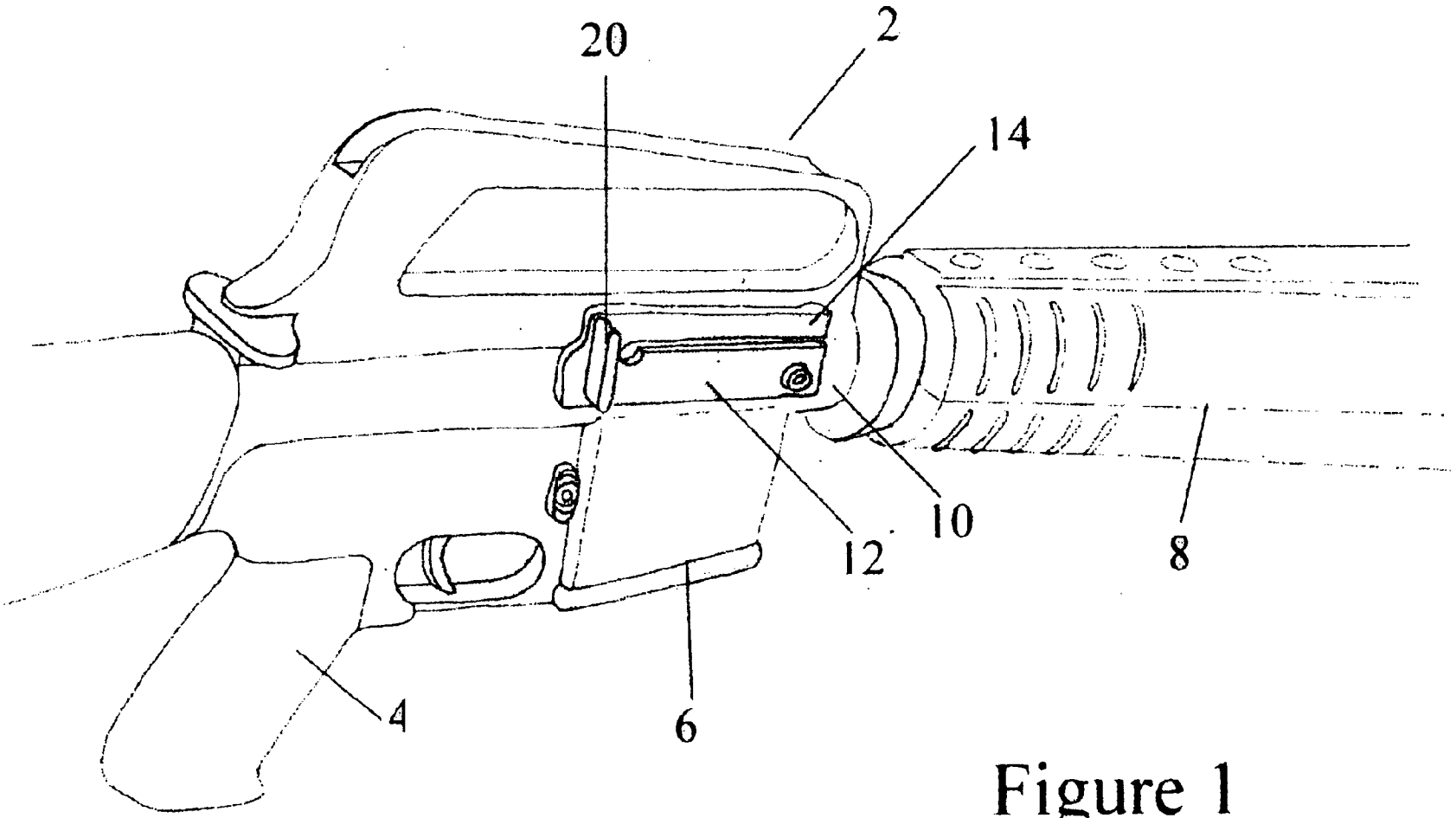
FIG. 1 is a perspective view of a firearm (AR-15 family) with the present invention installed.

With reference now to the drawings, the preferred embodiment of the safety indicator is herein described. With reference to FIG. 1, the indicator 10 is inserted in the rifle's 2 ejection port, directly over the magazine well 6 and behind the barrel 8.

Figure 2:
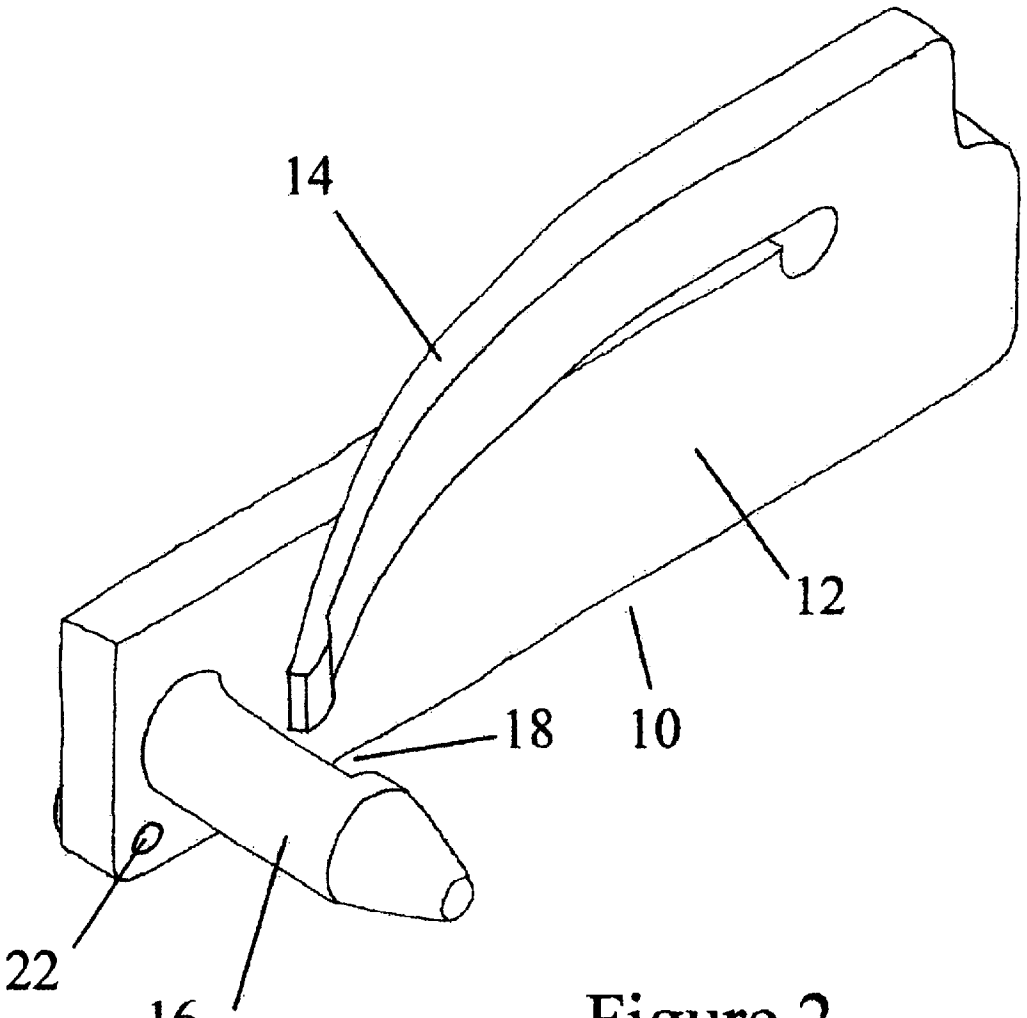
FIG. 2 is a rear perspective view of the invention.
Figure 3:
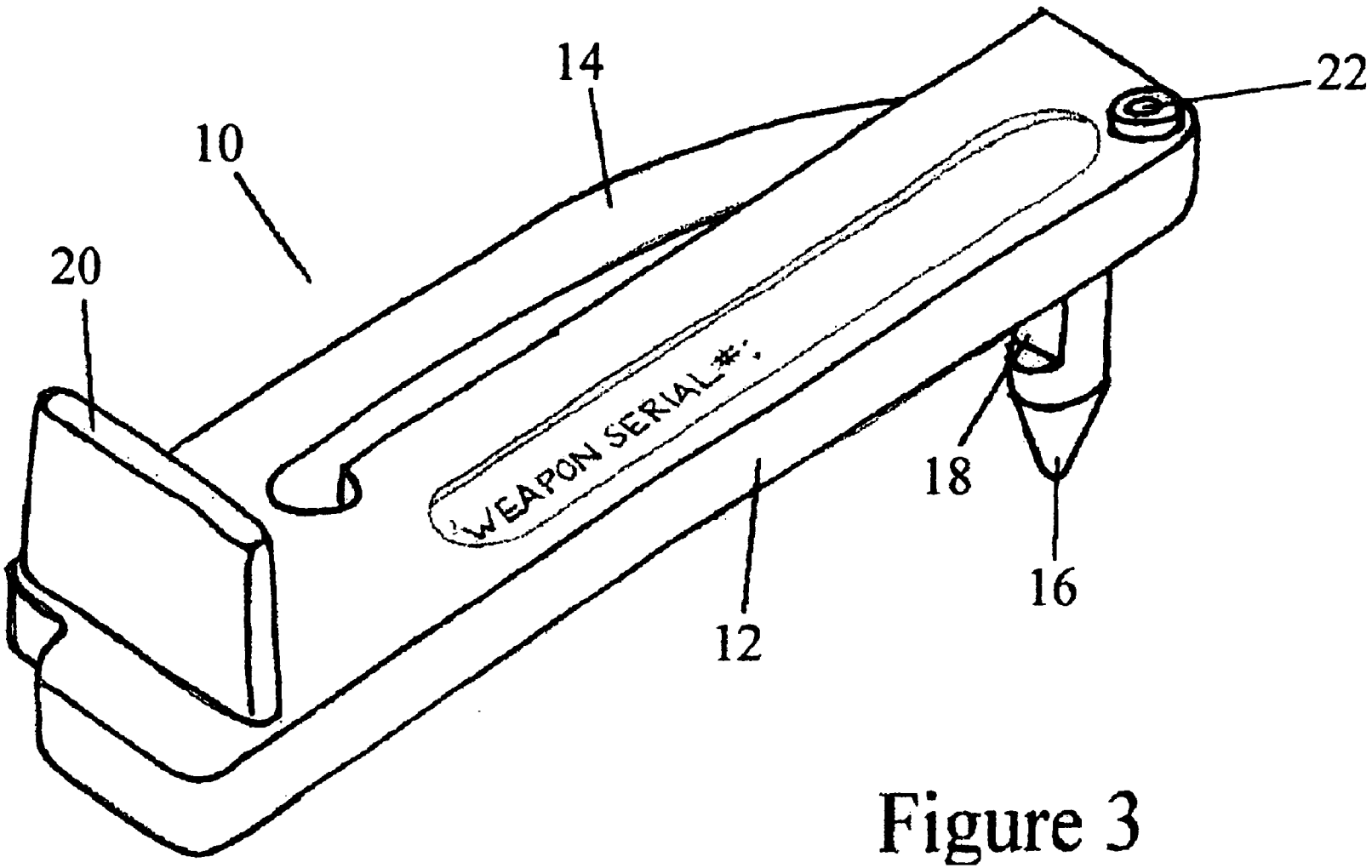
FIG. 3 is a top perspective view of the invention.

Referring now to FIGS. 2 and 3, the construction of the indicator 10 is relatively simple. A rectilinear body is almost dissected into two parts, a main body 12 and a spring body 14. An indicator flag 20 extends perpendicularly from a point on the rectilinear body that has not been divided. Flag 20 defines the top of the indicator body. Spring body 14 is bent downwards. The resultant curved cantilever spring provides thrust necessary for self-ejection. Peg 16 also extends downwards, starting from a point opposite the indicator flag 20 on the main body 12. A notch 18 is positioned in peg 16, facing back towards the rest of the indicator's main body 12. The length of notch 18 is dependent on the length necessary to capture bolt lip 46 (FIG. 5) when spring body 14 is compressed against the weapon. This length will vary depending on caliber and type of weapon.

Figure 4:
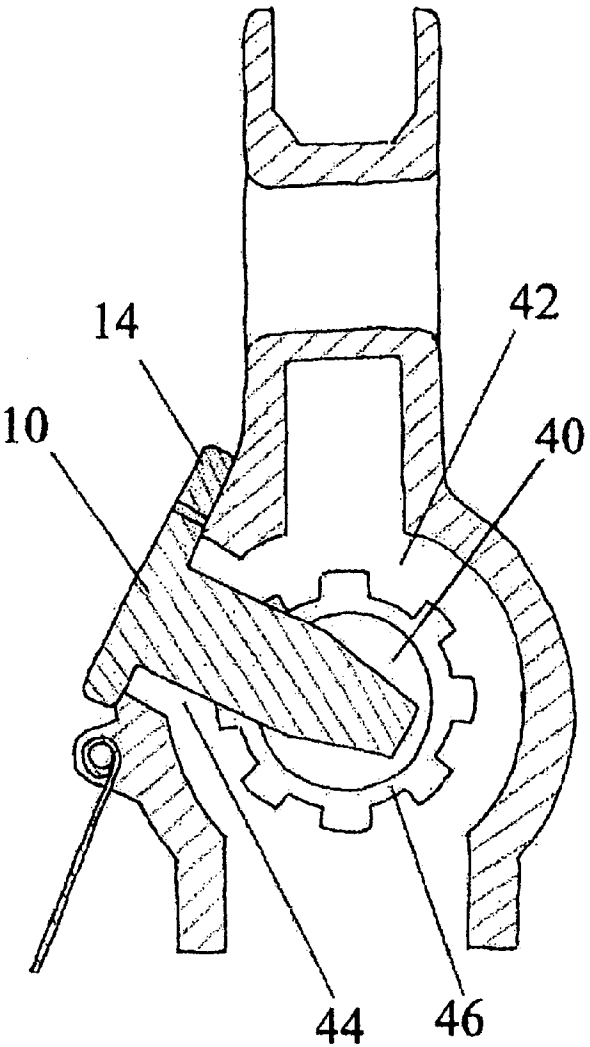
FIG. 4 is a vertical cross-section of the rifle of FIG. 1 at the point where the bolt and indicator interface.
Figure 5:
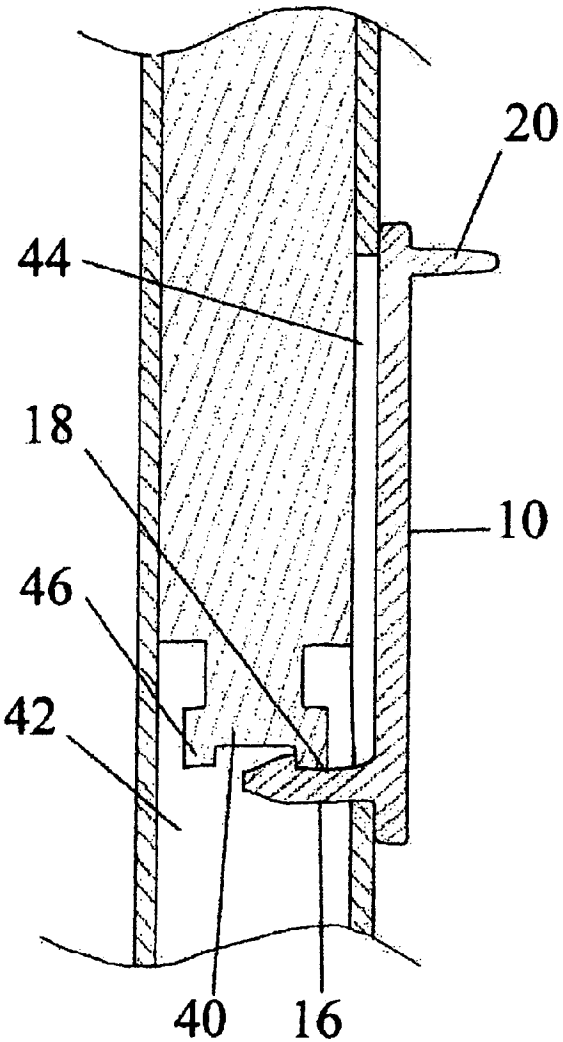
FIG. 5 is a horizontal cross-section of the rifle of FIG. 1 taken along the length of the barrel at the chamber ejection port.

The interface with the rifle is better shown in FIGS. 4 and 5, where peg 16 is inserted into the chamber 42 through the ejection port 44 and interfaces with bolt 40 with notch 18. As shown in FIG. 5, notch 18 catches the lip 46 of bolt 40. Bolt 40 then holds indicator 10 in place. Spring body 14 is therefore compressed, flush against the body of rifle 2. When the bolt 40 is actuated, in preparation for firing, peg 16 is released, thus releasing spring body 14 and thrusting indicator 10 away from the weapon.

Figure 6:
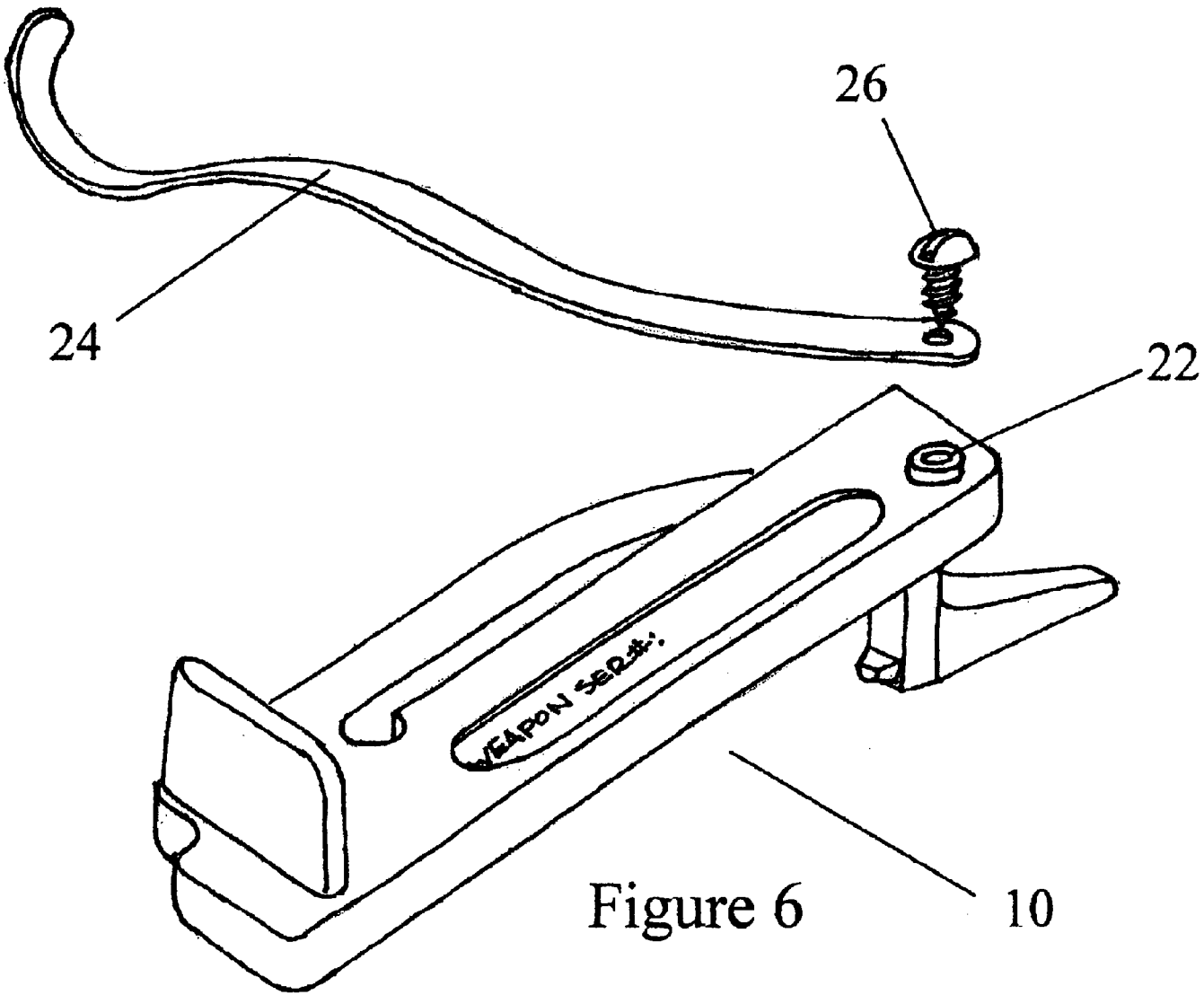
FIG. 6 is a perspective view of the invention with an additional long flag.

In a number of instances, a weapon may be stowed in a manner that the ejection port is hidden from view. An example would be storing a weapon in a roof rack in a vehicle. For this purpose, shown in FIG. 6, a long indicator flag 24 may be attached to the main body 10 at hole 22 by using screw 26. In so doing, long indicator flag 24 will extend around the weapon to a position in view. Any means to attach the long indicator flag 24 may be used, including adhesive.

Figure 7:
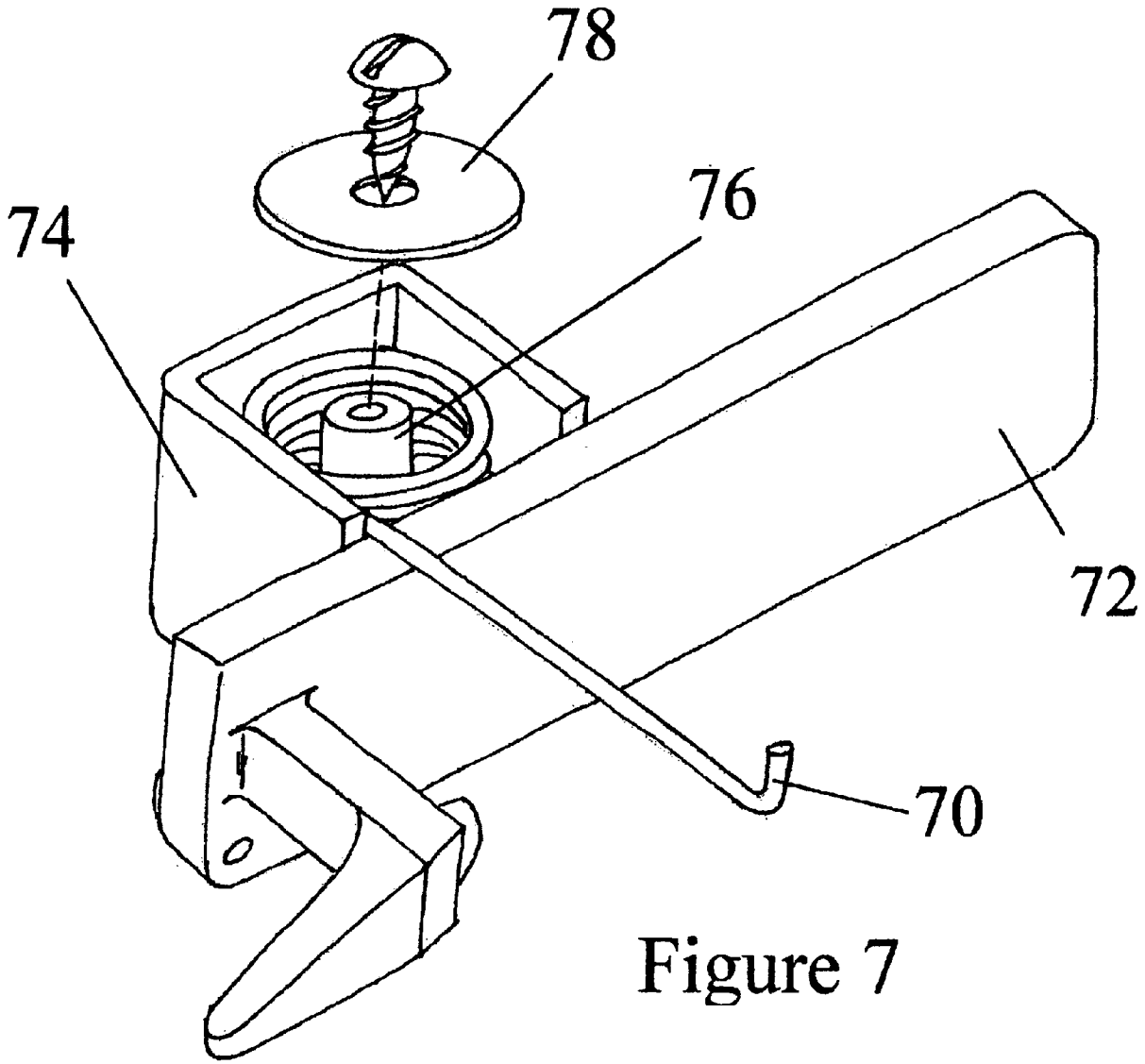
FIG. 7 is a semi-exploded view of the invention utilizing a metal spring.

In an alternative embodiment, shown in FIG. 7, a separate spring member 70 is affixed to the underside of a unified main body 72. The spring member 70, therefore, replaces the spring body. Ideally, spring member 70 is a coiled spring mostly encased in housing 74 about axel 76. Washer 78 is screwed into axel 76 so as to retain spring body 70. However, any construction of housing 70 and washer 78 assembly that retains spring member 70 may be utilized.

The preferred embodiment, utilizing the main body 10 and spring body 12, may be molded from a single-staged mold or otherwise fashioned in a single step, thereby making the alternate embodiment, using the spring member 60, relatively cost prohibitive. The indicator according to this invention may be made for any type of firearm in current use, provided the firearm has some form of ejection port and a firing bolt, regardless of size or caliber.

Although the present invention has been described with reference to preferred embodiments, numerous modifications and variations can be made and still the result will come within the scope of the invention. No limitation with respect to the specific embodiments disclosed herein is intended or should be inferred.

I claim:

1. A firearm safety indicator for a firearm having an ejection port and a closely associated firing bolt comprising:

a. a rectilinear indicator body an underside of which defining a plane of the rectilinear body;

b. a spring, and c. a peg member extending in a generally perpendicular direction from the underside of the rectilinear body;

wherein, the indicator is slightly larger in dimensions than said ejection port, the spring stores potential energy for self-ejection when the indicator is installed, and the spring applies force along a vector perpendicular to the plane of the rectilinear body.

2. The indicator of claim 1, further comprising a notch located on the peg member, said notch disposed so as to interface with the firing bolt.

3. The indicator of claim 2, further comprising a second, long indicator flag attachable to the indicator body and a means for attaching the flag to the indicator body.

4. The indicator of claim 3, wherein the material from which the indicator body is made is selected from the group of material consisting of: plastic, nylon, resin, metal, or wood.

5. The indicator of claim 2, wherein the material from which the indicator body is made is selected from the group of material consisting of: plastic, nylon, resin, metal, or wood.

6. The indicator of claim 1, further comprising a second, long indicator flag attachable to the indicator body and a means for attaching the flag to the indicator body.

7. The indicator of claim 6, wherein the material from which the indicator body is made is selected from the group of material consisting of: plastic, nylon, resin, metal, or wood.

8. The indicator of claim 1, wherein the material from which the indicator body is made is selected from the group of material consisting of: plastic, nylon, resin, metal, or wood.

9. The indicator of claim 1, the spring comprising a spring member attached to the underside of the rectilinear body.

10. The indicator of claim 9, further comprising a notch located on the peg member, said notch disposed so as to interface with the firing bolt.

11. The indicator of claim 10, further comprising a second, long indicator flag attachable to the indicator body and a means for attaching the flag to the indicator body.

12. The indicator of claim 11, wherein the material from which the indicator body is made is selected from the group of material consisting of: plastic, nylon, resin, metal, or wood.

13. The indicator of claim 10, wherein the material from which the indicator body is made is selected from the group of material consisting of: plastic, nylon, resin, metal, or wood.

14. The indicator of claim 9, further comprising a second, long indicator flag attachable to the indicator body and a means for attaching the flag to the indicator body.

15. The indicator of claim 14, wherein the material from which the indicator body is made is selected from the group of material consisting of: plastic, nylon, resin, metal, or wood.

16. The indicator of claim 9, wherein the material from which the indicator body is made is selected from the group of material consisting of: plastic, nylon, resin, metal, or wood.

17. A firearm safety indicator for a firearm having an ejection port and a closely associated firing bolt comprising:

a. a main indicator body further comprising:

i. a juncture section;

ii. a rectilinear cover body extending from the juncture section; and iii. a rectilinear spring body extending from the juncture section in a direction generally parallel to and in the same direction as the cover body, except that the spring body is simultaneously disposed in a downwards curve as distance from the juncture section is increased; and b. a peg member, extending downwards from the cover body in a perpendicular direction from a point on the main body opposite the juncture section;

wherein, the main indicator body is generally rectilinear and is slightly larger in dimensions than the ejection port and the spring body stores potential energy for self-ejection when the indicator is installed.

18. The indicator of claim 17, further comprising a notch located on the peg member, said notch disposed so as to interface with the firing bolt.

19. The indicator of claim 18, further comprising a second, long indicator flag attachable to the indicator body and a means for attaching the flag to the indicator body.

20. The indicator of claim 19, wherein the material from which the indicator is made is selected from the group of material consisting of: plastic, nylon, resin, metal, or wood.

21. The indicator of claim 18, wherein the material from which the indicator is made is selected from the group of material consisting of: plastic, nylon, resin, metal, or wood.

22. The indicator of claim 17, further comprising a second, long indicator flag attachable to the indicator body and a means for attaching the flag to the indicator body.

23. The indicator of claim 22, wherein the material from which the indicator is made is selected from the group of material consisting of: plastic, nylon, resin, metal, or wood.

24. The indicator of claim 17, wherein the material from which the indicator is made is selected from the group of material consisting of plastic, nylon, resin, metal, or wood.

* * * * *